US005196731A

United States Patent [19]

Abe et al.

[11] Patent Number: 5,196,731

[45] Date of Patent: Mar. 23, 1993

[54] POWER ON/OFF CIRCUIT WITH LOCK FUNCTION

[75] Inventors: Katsumi Abe; Akinori Takie, both of Tokyo, Japan

[73] Assignee: U. S. Philips Corporation, New York, N.Y.

[21] Appl. No.: 661,924

[22] Filed: Feb. 26, 1991

[30] Foreign Application Priority Data

Mar. 1, 1990 [JP] Japan ..... 2-49817

[51] Int. Cl.[5] ..... H01H 3/00; B26B 19/00

[52] U.S. Cl. ..... 307/142; 307/140; 30/45

[58] Field of Search ..... 307/112, 113, 116, 140, 307/142; 361/189-191, 210; 30/41.7, 41.8, 45

[56] References Cited

U.S. PATENT DOCUMENTS

| | | | |
|---|---|---|---|
| 3,793,567 | 2/1974 | Hotte | 361/189 |
| 3,986,039 | 10/1976 | Bovitz | 307/137 |
| 4,029,996 | 6/1977 | Miffitt | 307/116 X |
| 4,274,638 | 6/1981 | Jullien | 200/61.1 X |
| 4,531,287 | 7/1985 | Shibata et al. | 200/600 X |
| 4,559,456 | 12/1985 | Yamamoto et al. | 307/66 |

OTHER PUBLICATIONS

Tyler, T. "Inverters provide On-Off from momentary switch", EDN, vol 21, No. 12, (Jun. 20, 1976), p. 126. TK 1.E275.

*Primary Examiner*—A. D. Pellinen
*Assistant Examiner*—F. M. Fleming
*Attorney, Agent, or Firm*—Bernard Franzblua

[57] ABSTRACT

A power on/off circuit with a lock function includes a momentary type main switch connected to ground, a two-circuit two-contact lock switch coupled to, a switching state holding circuit, a load and a power supply. One of the switching circuits in the lock switch is connected between the main switch and the input terminal (CK) of the switching state holding circuit. The other switching circuit in the lock switch is connected between the main switch and the reset terminal (CLR) of the switching state holding circuit. The switching state of the main switch is held by the switching state holding circuit, and the state is maintained unless a reset signal is applied to the switching state holding circuit. The lock switch only functions to generate the reset signal so that the lock switch does not cut off the supply of current to the load as in a conventional shaver.

20 Claims, 1 Drawing Sheet

POWER ON/OFF CIRCUIT WITH LOCK FUNCTION

FIELD OF THE INVENTION

This invention relates to a power on/off circuit with lock function comprising a power supply and a load, a main switch and a lock switch arranged to enable and disable a connection between the power supply and the load by means of the main switch if the lock switch is in a first and second position, respectively.

BACKGROUND OF THE INVENTION

Portable shavers are equipped with a main switch which turns a motor on/off, and a locking system which stops this function. The locking system is provided to prevent the main switch from being accidentally turned on due to an external shock and the like. As a result, the motor will not rotate and consume battery energy, when the portable shaver is contained and carried in a suitcase or the like.

As a practical means for realizing this locking system, there are known mechanical locking means and electrical means utilizing a slide switch. Mechanical locking means are arranged so that the switch bar of the main switch is mechanically locked to prevent it from moving to the on-position when the main switch is in the off-position, and the main switch is not mechanically locked when the main switch is in the on-position. On the other hand, as shown in FIG. 1, with the locking system using electrical means, a locked state is realized by turning a lock slide switch 28, which is connected in series with a main switch 27, to the off-position, so that the power to the load will be cut off.

In recent years, push type switches have come into use widely as the main switch. The push type switches are a type of switch turned on/off by depressing a switch button, and there are types in which the depressed state is held (alternate type) and types in which the depressed state returns to the previous state as soon as the finger is removed (momentary type). Especially, soft touch momentary type switches are used frequently nowadays.

In battery operated portable shavers utilizing a momentary type switch as the main switch (hereinafter referred to as momentary switch type shavers), a pulse is generated each time the main switch is depressed, and the switched state is held by means of a state holding circuit until the next pulse is sent.

As shown in FIG. 1, in conventional shavers in which an alternate type main switch 27 and a lock switch 28 are connected in series, the rotation of a motor 23 is stopped when the lock switch 28 is turned on with the main switch 27 in the on state. Thus, the motor can be stopped not only by the main switch but also by the lock switch. This results in a problem in that it is difficult to determine which switch is the main switch.

Such a problem does not exist when a mechanical locking system is used. However, locking means utilizing a mechanical means cannot be used in momentary switch type shavers. This is because a switch on/off signal cannot be sent to the state holding circuit when the main switch operation is disabled by the mechanical means. On the other hand, if a microprocessor is used, it is possible to realize a momentary switch type shaver in which the function of the main switch and lock switch are clearly separated. However, microprocessors are rather expensive and require expensive development costs for deriving its software.

Momentary type switches have recently come into use not only in shavers as mentioned above, but as the main switch of headphone stereo sets. However, headphone stereo sets are conventionally not equipped with a lock switch. Therefore, when a headphone stereo set having this type of main switch is carried in a pocket and the like, there is a problem that the main switch can be depressed, and the headphone stereo set operates, and consequently the battery energy is consumed completely.

SUMMARY OF THE INVENTION

An object of the invention is to provide a power on/off circuit with a lock function not having the aforementioned problems. This object is, according to the invention, realised by a power on/off circuit as specified in the opening paragraph which is characterized in that the main switch is a momentary type switch, the lock switch is a two-switching circuit two-contact type switch, the power on/off circuit further comprises a switching state holding circuit, one of the switching circuits of the lock switch being connected between the main switch and an input terminal of the switching state holding circuit, the other switching circuit of the lock switch being connected between the main switch and a reset terminal of the switching state holding circuit.

With this circuit, the state of the main switch is held by the switching state holding circuit, and the state is held unless a reset signal is given to the switching state holding circuit. Since the lock switch only has the function of generating the reset signal, there is no possibility that the lock switch will cut off the supply of current to the load. This means that the motor is not turned on/off by the lock switch and therefore it is possible to clearly separate the function of the main switch and the lock switch.

Moreover, this lock function can be realized using a cheap flip flop without using an expensive microprocessor.

Also, when this power on/off circuit with the lock function is incorporated in electronic devices such as headphone stereo sets which utilize a momentary type switch as the main switch, there is no possibility of cancellation of the on-state of the lock switch resulting in turning off of the main switch even if the electronic devices are contained and carried in a suitcase, and thus the accident that the battery energy is consumed completely will not happen.

A first embodiment of the power on/off circuit with a lock function is characterized in that a low pass filter is provided between the input terminal of the switching state holding circuit and the one of the switching circuits of the lock switch. The low pass filter between the input terminal of the switching holding circuit and one of the circuits of lock switch prevents a malfunction due to noise.

It is preferable to use a D-type flip-flop as the switching state holding circuit of the power on/off circuit.

In particular, when conductive rubber is used for the switch contact of the main switch, a wave shaping circuit in front of the switching state holding circuit is suitable.

BRIEF EXPLANATION OF THE DRAWINGS

An embodiment of the invention will now be described in more detail, by way of example, with reference to the accompanying drawings, wherein.

DESCRIPTION OF THE PREFERRED EMBODIMENTS

Figure 1:
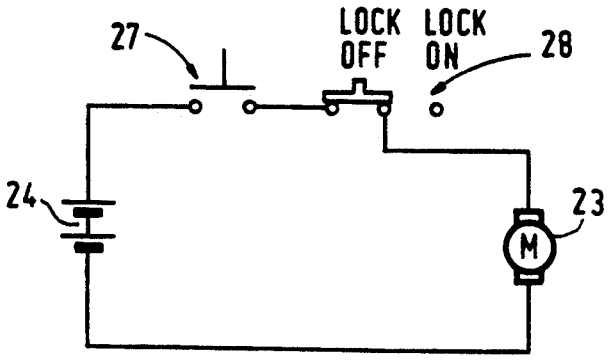
FIG.1 PRIOR ART
FIG. 1 shows a prior art power on/off circuit with a lock function.
Figure 2:
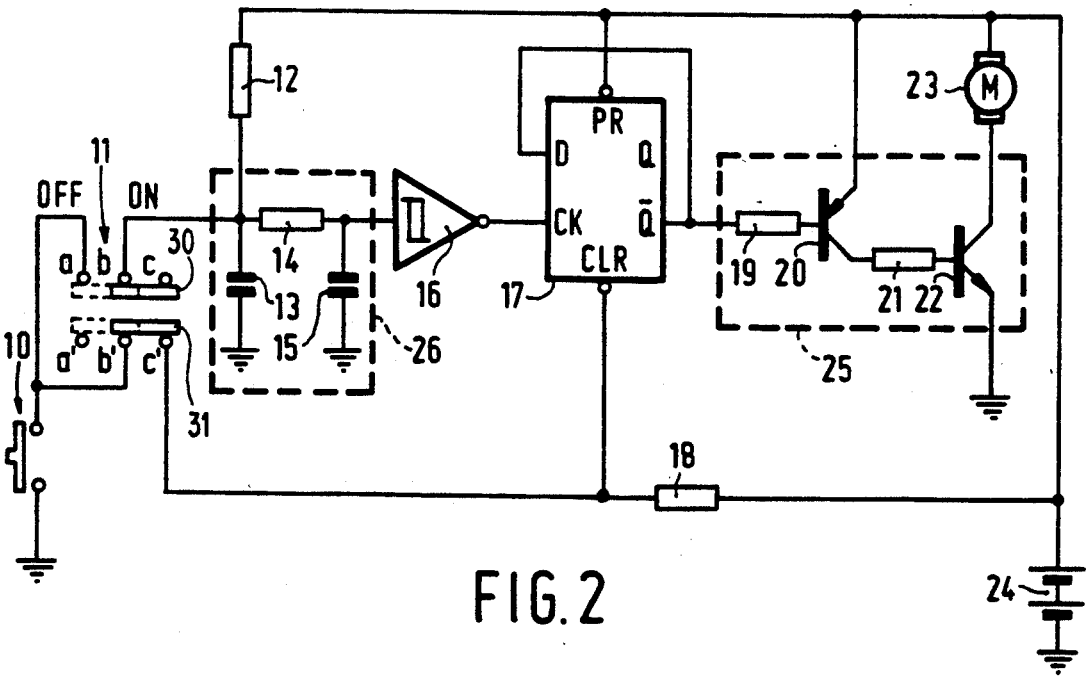
FIG. 2 shows a power on/off circuit with a lock function according to the invention.

FIG. 2 shows an embodiment wherein the power on/off circuit according to the invention is used in a momentary switch type shaver. The power on/off circuit with a lock function consists of a main switch 10, a kind of single pole single throw switch, a lock switch 11 i.e. a kind of double pole double throw switch, a low pass filter 26, a wave forming circuit 16, a stable switching state holding circuit 17, a motor 23 and a driving circuit 25 thereof, and a battery 24.

The main switch 10 comprises a soft touch momentary type switch which is a kind of push type switch, and one of its contacts is connected to ground while the other contact is connected to a contact a and a contact b' of a slide type lock switch 11.

The momentary type switch is a type of switch in which a pulse is generated each time a push button is depressed and the push button returns to the previous state instantaneously. The soft touch feeling can be obtained by using conductive rubber for the contact portion of the main switch 10. This conductive rubber contact improves the feel of using the switch, whereas the intrinsic resistance of the rubber itself degrades the rising characteristic of the waveform of the pulses which are generated by turning the contact on/off.

The lock switch 11 is a two-circuit two contact slide switch which, through the movement of a slide piece 30, 31, realizes a lock-on-state as shown, wherein common terminals or contacts b and b' are connected to contacts c and c' respectively, and a lock-cancellation-state or lock-off-state, wherein contacts b and b' are connected to contacts a and a' respectively. The contact b is connected to the input of the low pass filter 26, and the contact c' is connected to a reset terminal of the switching state holding circuit 17.

The respective contacts of the main switch 10 and lock switch 11 may be formed on a printed circuit board. In this case, since it is not necessary to obtain each contact as an individual part, the manufacturing cost of shavers may be reduced.

The low pass filter 26 comprises a resistor 14 and capacitors 13 and 15. The resistor 14 is connected between the input and the output of the low pass filter 26 and the capacitor 13 and 15 are connected between ground (i.e. the first terminal of power supply 24) and the input and the output respectively of the low pass filter 26. The output thereof is connected to the input terminal of the wave forming circuit 16. The low pass filter 26 is provided to prevent malfunction of the switching state holding circuit 17 due to noise, including high frequency components and contact noise (chattering), which is generated when the main switch 10 is activated. This low pass filter may be removed where the malfunction due to noise is not a concern. A pull up resistor 12 is connected between the input of the low pass filter 26 and the positive pole of the battery 24, i.e. the second terminal of the battery power supply.

A Schmitt trigger inverter is used as the wave forming circuit 16. It outputs a reshaped pulse in response to an input voltage exceeding a certain threshold. In particular, when a soft touch momentary push type switch which uses conductive rubber for the contact of the main switch 10 is used, the rising characteristic of the pulse generated by this switch is not suitable to trigger the holding circuit 17. The waveform is then reshaped in the Schmitt trigger inverter 16.

A D-type flip-flop is used as the switching state holding circuit 17. The output of the Schmitt trigger inverter 16 is connected to the clock terminal CK of the D-type flip-flop. The preset terminal PR of the flip flop is connected to the positive pole of the battery 24 and set at H (high) level. Further, the $\overline{Q}$ output terminal of the flip flop is connected to a D input terminal and to the motor driving circuit 25.

The motor driving circuit 25 is formed by a modified Darlington-connected PNP transistor 20 and NPN transistor 22. Current limiting resistors 19 and 21 are connected in the base circuits of transistors 20 and 22, respectively.

The motor 23 is connected between the positive pole of the battery 24 and the collector of the NPN transistor 22.

The reset terminal CLR of the D-type flip-flop is connected to the positive pole of the battery 24 through a pull up resistor 18.

When the power supply is connected (in practice, when the batteries are set), a voltage at H level is applied to the preset terminal PR and to the reset terminal CLR of the D-type flip-flop, whereby the output $\overline{Q}$ becomes H level. Since a voltage at H level is applied to the base of the PNP transistor 20, the PNP transistor turns off. This causes the NPN transistor 22 to also turn off, and as a result, no current is supplied to the motor 23.

When the button of the main switch 10 is depressed under the condition that the slide piece of the lock switch 11 has been moved to the off position, as shown by dashed lines in the figure (the locked state has been cancelled), a pulse is generated and it is sent to the low pass filter 26 via contacts a and b and slide piece 30. The pulse passes the low pass filter 26 and is applied to the clock terminal CK of the D type flip flop, the terminal $\overline{Q}$ is switched from H level to L (low) level because both the preset PR terminal and reset CLR terminal have already been set at H level. Thus, a current flows to the base of the PNP transistor 20, which causes a base current to flow to the NPN transistor 22 resulting in the supply of current to the motor 23.

Next, when the main switch 10 is depressed again, a pulse is given to the clock terminal of the D type flip flop again and the output $\overline{Q}$ undergoes inversion from L level to H level thereby causing the motor driving circuit 25 to stop the supply of current to the motor 23.

Thus, as long as the lock switch 11 is in the off position, the motor can be turned on/off each time the main switch 10 is depressed.

Since a new pulse is not applied to the clock terminal of the D-type flip-flop, even if the lock switch 11 is slided to the lock-on position while the motor 23 is being driven (the state wherein the slide piece is in the on position as shown in the figure), the L level of the output $\overline{Q}$ is held as it is, and the motor driving circuit 25 continues to supply the current to the motor 23. Therefore, the lock switch 11 does not function in this case.

If the main switch 10 is depressed in the lock-on-state of lock switch 11, the reset terminal CLR of the D type flip flop is connected the ground level through the contacts b' and c', and the D type flip flop is reset. As a result, the output $\overline{Q}$ becomes H level and the motor driving circuit 25 stops supplying current to the motor 23.

Thereafter, since the circuit from the main switch 10 to the clock terminal of the D-type flip-flop is disconnected, pressing the main switch 10 again does not cause re-inversion of the $\overline{Q}$ terminal of the D type flip flop 17, and the motor 23 is thus kept off.

As a contact of the main switch 10, a metal contact may be used instead of conductive rubber. In this case, the wave forming circuit 16 may be omitted because the pulse generated by a metal contact rises abruptly. However, in this case, the switching state holding circuit 17 must respond to the falling edge of the pulse.

In the above embodiment, an example of the application of the power on/off circuit of this invention to a shaver has been described. The application of the power on/off circuit of this invention is not limited thereto and it may also be applied to other portable electronic devices such as headphone stereo sets and the like. In this case, the power on/off circuit of this invention may be used by replacing the portion of the motor 23 in FIG. 2 with the electrical circuit of the portable electronic device.

We claim:

1. A power on/off circuit with a lock function comprising: a power supply and a load, a main switch and a lock switch connected in said circuit so as to enable and disable a connection between the power supply and the load by operation of the main switch if the lock switch is in a first and second position, respectively, wherein the main switch is a momentary type switch and the lock switch is a two-switching circuit two-contact type switch, a switching state holding circuit having an output operable to control said connection between the power supply and the load, one switching circuit of the lock switch being connected between the main switch and an input terminal of the switching state holding circuit, the other switching circuit of the lock switch being connected between the main switch and a reset terminal of the switching state holding circuit, whereby it is only possible to open and close the connection between the power supply and the load by a manual operation of the main switch.

2. A circuit according to claim 1, further comprising a low pass filter coupled between the input terminal of the switching sate holding circuit and the one switching circuit of the lock switch.

3. A circuit according to claim 2, wherein the switching state holding circuit comprises a D type flip flop and the input terminal and the rest terminal comprise a clock terminal and a reset terminal, respectively, of the flip flop.

4. A circuit according to claim 2, further comprising a wave forming circuit connected in cascade with the low pass filter to the input terminal of the switching state holding circuit.

5. A circuit according to claim 4, wherein a switching contact of the main switch is a conductive rubber contact.

6. A circuit according to claim 2, wherein the load comprises a motor and a motor driving circuit.

7. A circuit according to claim 6, wherein the motor driving circuit comprises a circuit including transistors a modified Darlington connection.

8. A circuit according to claim 1, further comprising a wave forming circuit connected between said one switching circuit of the lock switch and the input terminal of the switching state holding circuit.

9. A power on/off circuit as claimed in claim 1 wherein said main switch and said lock switch only control the connection between the power supply and the load indirectly via operation of the switching state holding circuit.

10. A power on/off circuit as claimed in claim 1 wherein, when the lock switch is in its first position, the one switching circuit is connected between the main switch and the input terminal of the switching state holding circuit and the other switching circuit is disconnected from the reset terminal of the switching state holding circuit, an when the lock switch is in its second position, the other switching circuit is connected between the main switch nd the reset terminal of the switching state holding circuit and the one switching circuit disconnects the main switch from the input terminal of the switching state holding circuit.

11. A power on/off circuit having a locking function comprising:

a power supply for energizing a load, a bistable switching circuit having an output terminal for establishing a connection and a disconnection of the power supply to the load, said bistable circuit having an input terminal and a reset terminal, a momentary-type main switch, a lock-type switch having first lock-off and second lock-on operating states and a first and second set of contacts for defining a first and a second switching circuit, respectively, a first terminal of said power supply being coupled to said input terminal of the bistable switching circuit via a firs series circuit including said momentary-type main switch and said fist switching circuit of the lock-type switch when said lock-type switch is in said first operating state, said first terminal of the power supply being decoupled from the input terminal of the bistable switching circuit when said lock-type switch is in said second operating state, and wherein said first terminal of the power supply is coupled to said reset terminal of the bistable switching circuit via a second series circuit including said momentary type main switch and said second switching circuit of the lock-type switch when said lock-type switch is in said second operating state, said first terminal of the power supply being decoupled from the reset terminal of the bistable switching circuit when said lock-type switch is in said first operating state.

12. A power on/off circuit as claimed in claim 11 wherein said momentary-type main switch comprises s single pole single throw switch and said lock-type switch comprises a double pole double throw switch.

13. A power on/off circuit as claimed in claim 11 wherein said first series circuit includes a lowpass filter coupled between said first switching circuit of the lock-type switch and said input terminal of the bistable switching circuit.

14. A power on/off circuit as claimed in claim 11 wherein said first series circuit includes a Schmitt trigger type circuit coupled between said first switching circuit of the lock-type switch and said input terminal of the bistable switching circuit.

15. A power on/off circuit as claimed in claim 11 wherein said bistable switching circuit comprises a D-type flip-flop in which said input terminal, said reset terminal and said output terminal comprise a clock terminal, a reset terminal and an output terminal of the flip-flop, respectively, said flip-flop having a preset terminal connected to a second terminal of the power supply and a D input terminal connected to said output terminal of the flip-flop.

16. A power on/off circuit as claimed in claim 11 wherein said first and second sets of contacts each comprise three terminals with a common terminal of the first set of contacts connected to said input terminal of the bistable circuit, a common terminal of the second set of contacts and a first end terminal of the first set of contacts connected to one terminal of the single pole single throw switch, a second end terminal of the second second set of contacts connected to the reset terminal of the bistable switching circuit, and wherein the second end terminal of the first set of contacts and the first end terminal of the second set of contacts are left unconnected.

17. A power on/off circuit as claimed in claim 11 wherein the load comprises a motor for a dry shaver and a transistor drive circuit coupled between said output of the bistable switching circuit and said motor.

18. A power on/off circuit as claimed in claim 11 wherein said bistable switching circuit is controlled by said momentary-type main switch and said lock-type switch such that power to the load from the power supply cannot be switched on and off by operation of the lock-type switch alone.

19. A power on/off circuit with a lock function comprising:

a power supply for energizing a load, a manually operative momentary-type main switch for connecting and disconnecting the power supply to the load, a lock switch comprising a two-switching circuit two-contact type switch arranged to enable and disable a connection between the power supply and the load by operation of the main switch if the lock switch is in a first and second position, respectively, a D-type flip-flop having a clock input terminal, a reset terminal, and an output terminal for controlling said connection in response to said operation of the main switch, a first switching circuit of the lock switch being connected between the main switch and the clock input terminal of the D-type flip-flop, and wherein a second switching circuit of the lock switch is connected between the main switch and the reset terminal of the D-type flip-flop.

20. A power on/off circuit as claimed in claim 19 wherein the load comprises a motor of an electric shaver, and said lock switch has a first lock-off position in which the main switch is connected to said lock input terminal via the first switching circuit of the lock switch and is simultaneously disconnected from the reset terminal of the flip-flop and a second lock-on position in which the main switch is connected to said reset terminal via the second switching circuit of the lock switch and is simultaneously disconnected from the clock input terminal of the flip-flop.

* * * * *

UNITED STATES PATENT AND TRADEMARK OFFICE

CERTIFICATE OF CORRECTION

PATENT NO. : 5,196,731

DATED : March 3, 1993

INVENTOR(S) : KATSUMI ABE ET AL

It is certified that error appears in the above-indentified patent and that said Letters Patent is hereby corrected as shown below:

IN THE ABSTRACT line 3, after "to" delete ",".

Column 1, line 1, after "with" insert --a--;
line 20, after "energy" delete ",";
line 38, after "switch" insert --which is--;
Column 3, line 17, after "11" insert --,-- (comma);
line 19, change "stable" to --bistable--;
line 55, change "capacitor" to --capacitors--;
Column 5, line 3, after "connected" insert --to--.

Claim 10, column 6, line 19, change "an" to --and--;
line 21, change "nd" to --and--.

Claim 12, column 6, line 58, change "s" to --a--.

Claim 20, column 8, line 26, change "lock" to --clock--.

Signed and Sealed this

Twenty-ninth Day of March, 1994

Bruce Lehman

*Attest:*

BRUCE LEHMAN

*Attesting Officer*

*Commissioner of Patents and Trademarks*